US007704062B2

(12) United States Patent
Noelle et al.

(10) Patent No.: US 7,704,062 B2
(45) Date of Patent: Apr. 27, 2010

(54) MACHINE FOR THE PRODUCTION OF DIFFERENT QUALITY NONWOVENS

(75) Inventors: Frédéric Noelle, Saint Nazaire les Eymes (FR); André Michalon, Tresserve (FR)

(73) Assignee: Rieter Perfojet, Montbonnot (FR)

( * ) Notice: Subject to any disclaimer, the term of this patent is extended or adjusted under 35 U.S.C. 154(b) by 759 days.

(21) Appl. No.: 10/575,298

(22) PCT Filed: Oct. 26, 2004

(86) PCT No.: PCT/FR2004/002752

§ 371 (c)(1),
(2), (4) Date: Jan. 29, 2007

(87) PCT Pub. No.: WO2005/042820

PCT Pub. Date: May 12, 2005

(65) Prior Publication Data

US 2007/0271749 A1 Nov. 29, 2007

(30) Foreign Application Priority Data

Oct. 31, 2003 (FR) ..... 03 12795

(51) Int. Cl.
*D01D 5/00* (2006.01)
*D04H 5/02* (2006.01)

(52) U.S. Cl. ..... 425/72.2; 425/83.1; 425/363; 425/382.2; 425/404; 425/445; 425/464

(58) Field of Classification Search ..... 425/72.2, 425/83.1, 363, 382.2, 404, 445, 464
See application file for complete search history.

(56) References Cited

U.S. PATENT DOCUMENTS

| | | | | |
|---|---|---|---|---|
| 3,873,255 | A | 3/1975 | Kalwaites | |
| 4,623,575 | A | 11/1986 | Brooks et al. | |
| 4,879,170 | A * | 11/1989 | Radwanski et al. | 442/329 |
| 5,301,401 | A | 4/1994 | Suzuki et al. | |
| 5,405,650 | A | 4/1995 | Boulanger et al. | |
| 6,058,583 | A | 5/2000 | Takeuchi et al. | |
| 6,321,425 | B1 * | 11/2001 | Putnam et al. | 28/104 |
| 6,338,187 | B1 | 1/2002 | Fleissner | |
| 7,500,293 | B2 * | 3/2009 | Noelle | 28/104 |
| 2001/0005926 | A1 * | 7/2001 | Noelle | 28/104 |
| 2002/0046449 | A1 | 4/2002 | Fleissner | |
| 2002/0168910 | A1 * | 11/2002 | Vuillaume et al. | 442/381 |

* cited by examiner

*Primary Examiner*—Robert B Davis
*Assistant Examiner*—Joseph Leyson
(74) *Attorney, Agent, or Firm*—Pearne & Gordon LLP

(57) ABSTRACT

A nonwoven production machine includes a spun-bond tower for extruding filaments and associated apparatus for forming the filaments into a web that is consolidated by water jets, a web that is calendered and then softened by water jets, or a web that is only calendered.

7 Claims, 1 Drawing Sheet

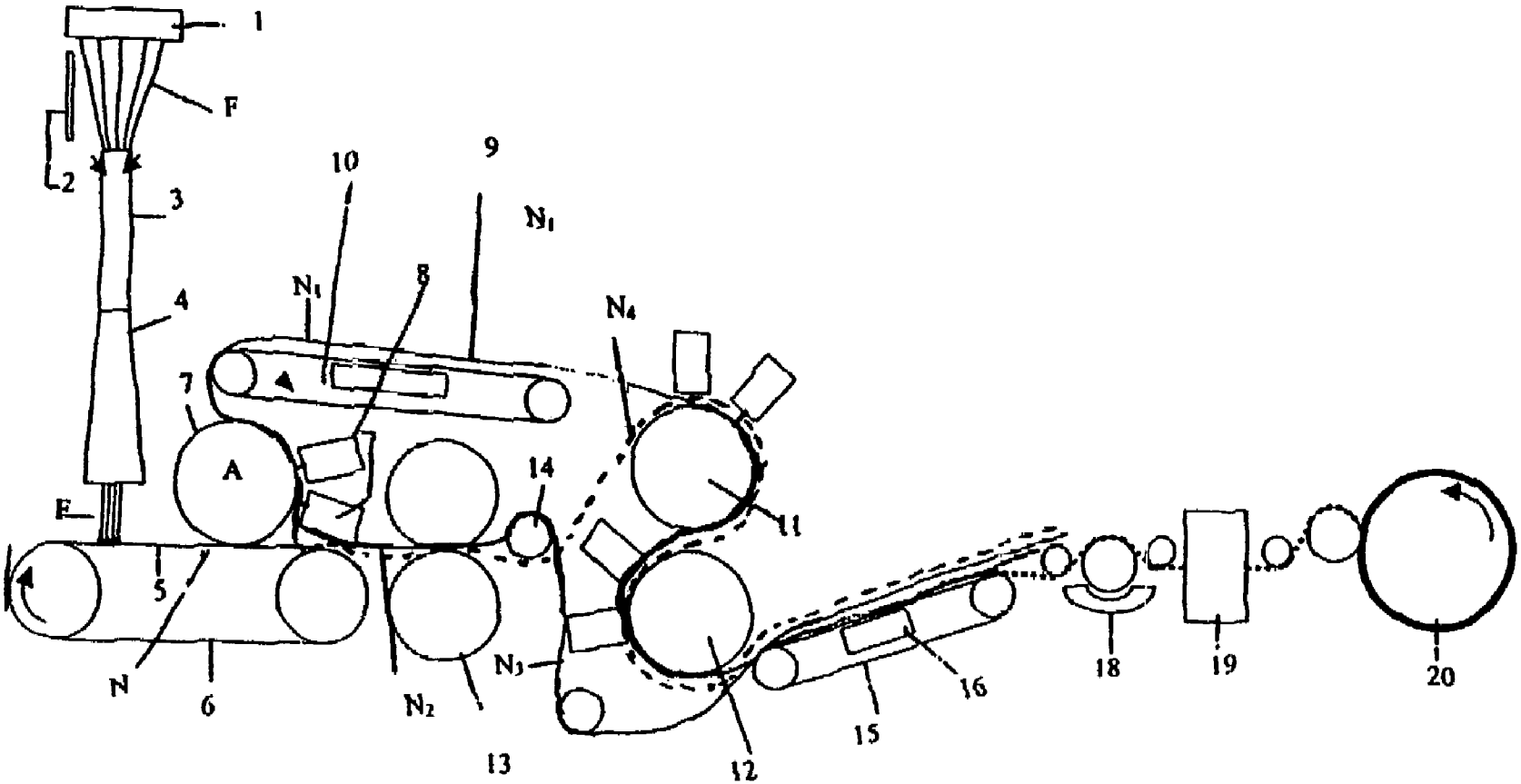
1
F
2
3
4
E
5
N
6
A
7
10
N1
8
9
N1
N4
11
12
14
N3
13
N2
15
16
18
19
20

MACHINE FOR THE PRODUCTION OF DIFFERENT QUALITY NONWOVENS

BACKGROUND OF THE INVENTION

The present invention relates to machines for the production of nonwovens and more particularly to machines for the production of nonwovens comprising one or more spun-bond towers and optionally one or more melt-blown heads depositing filaments or filaments and fibres (melt-blown webs) as a web onto the upper run of a conveyor. The web thus deposited, and still fragile, is sent to a water-jet consolidation unit.

These nonwoven production machines make it possible to obtain, for a given feed to the spun-bond tower, only a single grade of nonwoven.

The invention remedies this drawback by a nonwoven production machine that makes it possible, for the same feed to the spun-bond tower, to obtain nonwovens of different grades.

BRIEF SUMMARY OF THE INVENTION

The subject of the invention is therefore a nonwoven production machine comprising a spun-bond tower depositing filaments as a web onto the upper run of a first conveyor, characterized in that a first means is provided for forwarding the web from the first conveyor to a first water-jet consolidation unit along a path having a direction other than that of the upper run of the first conveyor and provided, downstream in the direction of the upper run of the first conveyor, are a calender and, downstream of this calender, a means for deflecting the calendered web as required either directly to an application unit for applying a product to the web, or indirectly, with interposition of a second water-jet consolidation unit, to the unit for applying a product to the web, and a second means for forwarding the web leaving the first consolidation unit to the second consolidation unit is provided.

Thus, one and the same machine may subject the web either to a simple calendering operation followed by a treatment by the application unit, this treatment possibly consisting of the application of surfactants, binders, lubricants, swelling agents or dyes, of a printing operation, followed by a drying operation and a wind-up operation, or to being forwarded to the calendering unit, then to the second consolidation unit and finally to the application unit, or to being forwarded to the first consolidation unit, then to the second consolidation unit and finally to the application unit. The first water-jet consolidation takes place with pressures of between 20 and 400 bar, the second takes place with pressures of between 50 and 600 bar, so as to soften the web after it has been calendered, or, if it has not been calendered, so as to further consolidate it or to perforate it or to create thereon logos or three-dimensional structures.

Each consolidation may take place for example using a drum or a conveyor, with projection of water jets.

According to one embodiment, the first forwarding means comprises a drum forming part of the device for carrying out the first water-jet consolidation. The deflection means may comprise simply a roll that deflects the web, making it bypass the second consolidation unit, or by making it pass therethrough depending on whether the web is passed around this roll along an arc that turns its concavity downwards or upwards. The second means for forwarding the web leaving the first consolidation unit to the second consolidation unit may consist of a second conveyor. Another possibility results in the alternative of either bypassing or effecting the second consolidation, the water-injectors not being turned on in the case of bypassing.

According to one advantageous embodiment, a means for expressing the moisture contained in the web is provided upstream of the application unit. This expressing means may consist in particular of a third conveyor provided with a device for creating a vacuum, for example of between 400 and 700 millibar. Thanks to this, it is now possible to make webs consisting of hydrophobic filaments, for example polypropylene, polyethylene or metallocene filaments, undergo a subsequent treatment with a surfactant and/or a binder or another ennobling treatment, since the web is dry enough for successfully receiving a treatment of this kind. Furthermore, there is less liquid to be evaporated during the drying operation thanks to this prior expressing treatment. The treatment may be carried out on one or both faces of the web, which may be a solid, structured or perforated web. Furthermore, the hydrophilic filaments may be dyed by the addition of additives or dyes in the spun-bond tower.

U.S. Pat. No. 5,301,401 and EP-A-0 072 691 do not describe a machine having several paths.

BRIEF DESCRIPTION OF THE DRAWING

The single FIGURE of the appended drawing illustrates the invention.

The FIGURE is a sectional schematic representation of a machine according to the invention.

DETAILED DESCRIPTION OF THE DRAWINGS

It comprises a spun-bond tower having an extruder for extruding an organic polymer melt that feeds a die 1 for producing a curtain of filaments F, a cooling zone 2 for solidifying the extruded filaments, at least on the surface, a suction device 3 in the form of a chamber in which the curtain of filaments is subjected to the action of high-velocity streams of air that draw the filaments, and a diffuser 4 allowing, at the exit of the suction device, the stream of air to be deflected and slowed down and the filaments F to be distributed in a random fashion as a web, which is deposited on the upper run 5 of an endless first conveyor 6. The filaments are in the form of a bundle of filaments F, lying perpendicular to the plane of the FIGURE.

Mounted above the upper run 5 is a horizontal drum 7 with an internal vacuum device shown symbolically by the letter A. The lateral surface of the drum 7 is perforated. The drum is rotated about its axis. The drum is surrounded by an apertured sleeve. Two injectors 8 project pressurized water jets onto the lateral face of the drum, it being possible for the web of filaments to pass in the form of the web $N_1$ between the drum 7 and the injectors 8 and thus to be consolidated. The jets may have a diameter of between 80 and 170 microns. The number of jets per metre may be between 1000 and 5000 and the water pressure in the injectors may be between 10 and 400 bar, while the vacuum in the drum 7 may be between minus 20 millibar and minus 500 millibar and the drum 7 may be driven at a speed of between 1 and 800 m/min. The web $N_1$ then passes onto the upper run 9 of a second conveyor 10 in order to reach a second drum 11 of the same structure and same operation as the drum 7. From the rum 11, the web passes onto a drum 12 provided, like the drum 11, with injectors. The drum 12 is similar to the drum 11 in its structure and in its operation.

Instead of making the web N pass over the drum 7 as a web $N_1$, it is possible to cut it and make it go as a web $N_2$ along the same direction as the upper run 5 of the conveyor 6 and to make it pass through a calender 13. Provided after the calender 13 is a deflection roll 14 which, depending on whether the web $N_2$ is made to pass over the upper part of the roll 14 or under the lower part of this roll 14, deflects the web as a web $N_3$ or as a web $N_4$. The web $N_3$ is forwarded directly to a third conveyor 15 provided with a moisture-expressing device 16, namely a device creating a vacuum of 600 millibar, and therefore bypassing the drums 11 and 12, whereas the web $N_4$ passes over these drums 11 and 12 before being taken, like the other webs $N_1$ and $N_3$, onto the conveyor 15 and from there to an application unit, which may comprise a station 18 for applying a surfactant and a binder, a drying station 19 and a wind-up station 20.

The dotted lines in the FIGURE show that all the webs $N_1$ to $N_4$ pass through the application unit.

The invention claimed is:

1. A nonwoven production machine including alternate path and pathways for selected web travel and processing comprising:

a spun bond tower for depositing filaments as a web on an upper run of a first conveyor extending a first direction, a first means for forwarding said web from said first conveyor to a first water jet consolidation unit along a path having a second direction other than said first direction, a second conveyor for forwarding the web leaving the first consolidation unit to a second waterjet consolidation unit, said web leaving said second waterjet consolidation unit being directed to an application unit for final processing, a calender located downstream of said first means in said first direction for producing a calendered web that has bypassed said first waterjet consolidation unit, said second waterjet consolidation unit being located downstream of said calender in said first direction, and a deflection means for deflecting said calendered web in a first pathway directly to said application unit or in a second pathway, different from said first pathway, to said second waterjet consolidation unit with said web then being directed from said second waterjet consolidation unit to said application unit, both pathways being possible with the production machine, whereby processing of said web produced by a single feed to said spun bond tower may be selected to form nonwoven of different grades corresponding with the selected processing.

2. The machine of claim 1, further including a third conveyor for receiving web directly from said deflection means or from said second waterjet consolidation unit for conveyance to said application unit.

3. The machine of claim 2, further including expressing means for providing a vacuum to withdraw water from said web received on said third conveyor.

4. The machine of claim 2, wherein said first means comprises a drum for forwarding web from said first conveyor and for cooperating with injectors impinging water on the web as it is forwarded by the drum to provide said first waterjet consolidation unit.

5. The machine of claim 4, wherein said drum also includes internal vacuum means to withdraw impinging water passing through the web.

6. The machine of claim 2, wherein said deflection means comprises a roll arranged to have said calendered web pass over or under the roll as the web is deflected along said first or second pathway.

7. The machine of claim 2, wherein said application unit includes a treating station for applying a surfactant or a binder to the web, a drying station and a wind-up station.

* * * * *